United States Patent [19]

Gutierrez et al.

[11] 4,396,144

[45] Aug. 2, 1983

[54] TELESCOPED CONTAINER

[75] Inventors: Augusto Gutierrez; Edgar Londoño, both of Cali, Colombia

[73] Assignee: Container Corporation of America, Chicago, Ill.

[21] Appl. No.: 370,723

[22] Filed: Apr. 22, 1982

[51] Int. Cl.[3] ..... B65D 5/32; B65D 43/02

[52] U.S. Cl. ..... 229/23 BT; 229/43

[58] Field of Search ..... 229/37 R, 23 R, 23 AB, 229/23 BT, 43

[56] References Cited

U.S. PATENT DOCUMENTS

| | | | |
|---|---|---|---|
| 2,382,891 | 8/1945 | McCormick | 229/37 R |
| 2,735,607 | 2/1956 | Wasyluka | 229/23 R |
| 2,783,933 | 3/1957 | Shartz | 229/37 R |
| 3,281,050 | 10/1966 | Suchodolski | 229/37 R |
| 3,310,221 | 3/1967 | Duncan | 229/41 B |
| 4,087,041 | 5/1978 | Centanni | 229/37 R |

FOREIGN PATENT DOCUMENTS

| | | | |
|---|---|---|---|
| 692219 | 8/1964 | Canada | 229/23 BT |
| 532549 | 1/1941 | United Kingdom | 229/37 R |

*Primary Examiner*—Herbert F. Ross

*Attorney, Agent, or Firm*—Richard W. Carpenter; Davis Chin

[57] ABSTRACT

A telescoped container for storage and transporting of foodstuffs comprising an opened top container body with an integral liner and a separate container cover telescopically disposed on the container body. The integral liner consists of four liner panels which are reversely folded to lie in face-to-face relationship with the outer surfaces of the sidewalls of the container body to form an outer perimetrical reinforcement.

2 Claims, 6 Drawing Figures

TELESCOPED CONTAINER

BACKGROUND OF THE INVENTION

1. Field of the Invention

This invention relates generally to paperboard containers adapted for packaging and shipment of foodstuffs, such as bananas and other similar commodities. More particularly, it relates to a box-like container consisting of an opened top container body with an integral liner to retain the foodstuffs therein and a separate opened bottom container cover for telescoping over the container body.

2. Description of the Prior Art

The prior art appears to be best exemplified in the following U.S. patents which were developed in a search directed to the subject matter of this application:

| | |
|---|---|
| 1,997,909 | 2,835,432 |
| 2,004,197 | 2,865,552 |
| 2,132,638 | 2,949,151 |
| 2,220,388 | 2,965,279 |
| 2,418,963 | 3,114,494 |
| 2,474,523 | 3,281,050 |
| 2,634,046 | 3,366,496 |
| 2,577,588 | 3,473,722 |
| 2,711,281 | 3,899,120 |
| 2,718,348 | 4,087,041 |
| 2,735,607 | 4,105,152 |

Cartons or containers for transporting commodities without permitting damage thereto were usually required to have a liner to form a double-walled thickness with the container body sidewall. Heretofore, a container of this type was constructed of three separate parts consisting of a container body A, a perimetrical reinforced liner B disposed inside the container body A, and a cover C telescoped over the container body A. For ease of understanding, such a container is shown in FIG. 6 and has been designated with the legend "Prior Art".

This prior art arrangement suffers from the disadvantage of requiring costly manufacturing procedures to form these three separate parts. Further, there was incurred increased labor costs in assembling the container into the set-up condition. It would, therefore, be desirable to provide a telescoped container wherein the liner is formed integral with the container body, thereby to facilitate manufacturing, assembling and use thereof.

SUMMARY OF THE INVENTION

Accordingly, it is a general object of the present invention to provide an improved telescoped container which is relatively simple and economical to manufacture and assemble, but yet overcomes the disadvantages of the prior art container.

It is another object of the present invention to provide a telescoped container wherein the container body is constructed with an integral, outer perimetrical liner.

It is another object of the present invention to provide a telescoped container wherein the panels of the container body are joined by double score lines along its upper edges to respective liner panels to increase stacking strength and enhance the appearance thereof.

It is still another object of the present invention to provide a telescoped container wherein short V-shaped slots are formed at certain corners between the body panels and liner panels so as to relieve stressing.

It is still another object of the present invention to provide the telescoped container wherein a second glue flap is joined to a free edge of one of the liner panels to facilitate assembly of the container.

BRIEF DESCRIPTION OF THE DRAWINGS

These and other objects and advantages of the present invention will become more fully apparent from the following detailed description when read in conjunction with the accompanying drawings wherein.

DETAILED DESCRIPTION OF THE PREFERRED EMBODIMENTS

Figure 1:
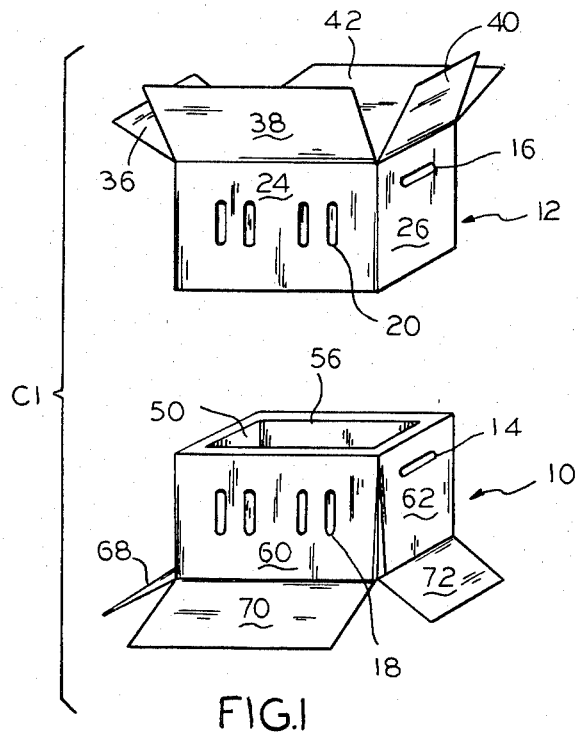
FIG. 1 is an exploded perspective view of a container embodying the features of the present invention with the container cover illustrated in its removed position from the container body thereof.

Referring now in detail to the various views of the drawings, there is shown in FIG. 1 a telescopable container C1 of the present invention comprising an opened top container body 10 with an integral liner adapted to retain foodstuffs such as bananas therein and a separate opened bottom container cover 12 adapted for telescoping engagement with the container body 10. The container body is provided with hand holes 14 formed in the opposed end wall panels thereof which are adapted for alignment with the corresponding hand holes 16 formed in the opposed end wall panels of the container cover 12. These hand holes 14 and 16 define carrying means to facilitate lifting and transporting of the container C1. Further, there are provided a plurality of air vents or holes 18 and 20 formed in the container body and cover, respectively, which cooperate with each other to provide for the passage of ambient air within the container to maintain the foodstuffs in a fresh condition.

Figure 2:
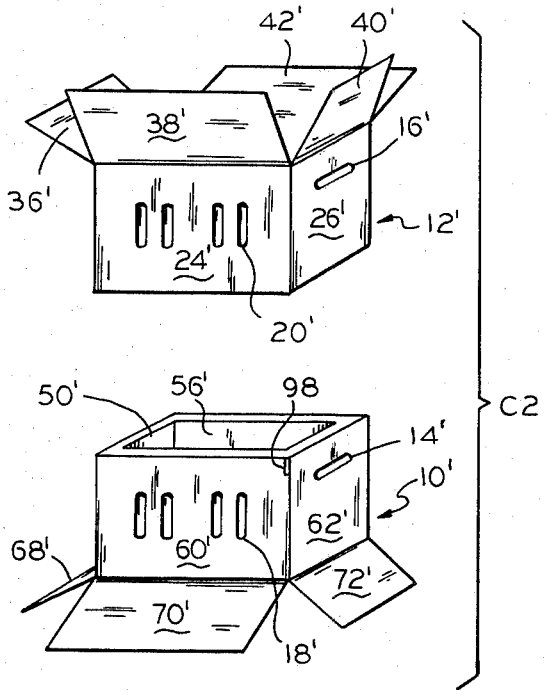
FIG. 2 is an exploded perspective view of a second embodiment of the container shown in FIG. 1.

FIG. 2 illustrates a second embodiment of the container C1 in FIG. 1 and has been designated generally by C2. Like reference numerals have been used throughout the drawings to refer to like parts, except accompanied by a prime mark. The modification in the container C2 is in the formation of the container body 10' which will be more fully described in detail hereinafter.

Figure 3:
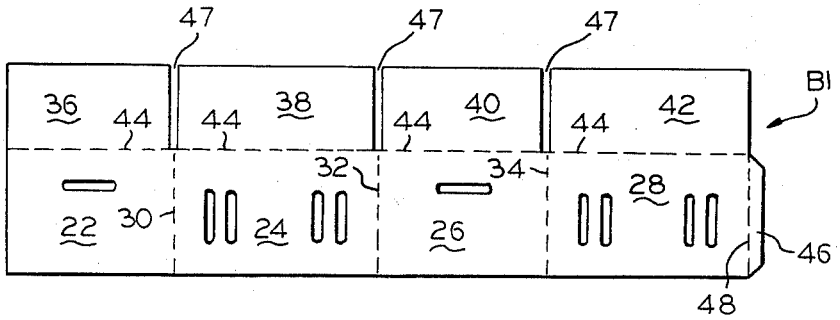
FIG. 3 is a top plan view of a one-piece blank utilized to form the container cover of FIGS. 1 and 2.

A one-piece blank B1 of a single sheet of suitable structural material such as corrugated paperboard or the like, as shown in FIG. 3, is utilized to form the container cover 12, 12' of FIGS. 1 and 2. The blank B1 has a plurality of wall panels 22, 24, 26 and 28 which are hingedly secured together in end-to-end in the series by vertical score lines 30, 32 and 34 respectively. Top closure flaps 36, 38, 40 and 42 are foldably joined to the related end and sidewalls 22, 24, 26 and 28 along longitudinal score lines 44. A glue flap or connecting flap 46 is connected to the endmost sidewall 28 along score line 48 to be used in forming the manufacturer's joint. The closure flaps 36, 38, 40, 42 are separated by slots 47 extending upwardly from the longitudinal score lines 44.

Figure 4:
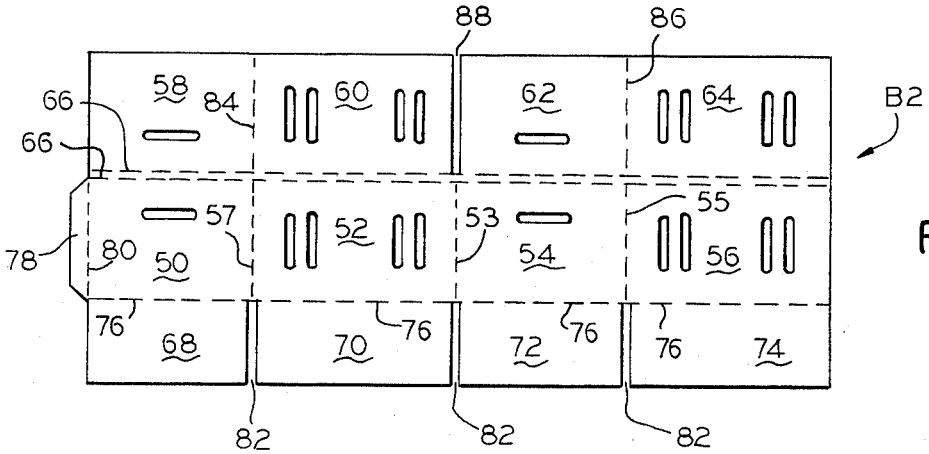
FIG. 4 is a top plan view of a one-piece blank utilized to form the container body of FIG. 1.

A one-piece blank B2 of suitable structural material such as corrugated paperboard or the like, as shown in FIG. 4, is utilized to form the container body 10 of FIG. 1. The blank B2 has a plurality of wall panels 50, 52, 54 and 56 which are hingedly secured together in end-to-end series by a plurality of corner score lines 51, 53 and 55. The wall panels 52, 56 are made to be relatively wider than the wall panels 50, 54. Therefore, the walls 52, 56 are referred to as sidewalls, and the wall panels 50, 54 are referred to as the end walls. Outer liner wall panels 58, 60, 62 and 64 are joined integrally to the respective wall panels 50, 52, 54 and 56 along longitudinal double score lines 66. Bottom closure flaps 68, 70, 72 and 74 are foldably connected to the lower edges of the respective end and sidewalls along longitudinal score lines 76.

A glue flap or connecting flap 78 to be used in forming the manufacturer's joint is foldably connected to the end wall panel 50 on the corner score line 80. The bottom closure flaps 68, 70, 72 and 74 are separated by slots 82 extending downwardly from the longitudinal score lines 76. The liner walls 58, 60 and 62, 64 are joined by corner or vertical score lines 84, 86 respectively. The liner panels 60, 62 are separated by a slot 88 extending upwardly from the double score lines 66.

In order to partially assemble the container body 10 for shipment to the customer, the blank C1 is initially folded on the score lines 51, 55 so as to overlap the free edge of the wall panel 56 onto the glue flap 78. Then, the end edge of the wall panel 56 is glued to the flap 78. If desired, taping, stitching, stapling or any other suitable means may be used in lieu of the glueing. When the customer receives the container body 10 in this knocked-down condition, he completes the erection of the container body 10 by first applying pressure at the opposed corner score lines 51, 55 so as to open up and then reversely fold the blank on the other pair of corner score lines 53, 80. In this condition, the outer liner walls 58, 60, 62 and 64 are folded outwardly and downwardly to lie in face-to-face relationship with the respective end and sidewalls for forming an outer perimetrical reinforcement to provide a double thickness sidewall in the container body. The container body 10 is now ready to be opened up or erected so as to have its bottom closure flaps brought into the closed position.

It should be noted that the heights of the outer liner walls 58, 60, 62 and 64 are slightly greater than the heights of the end and sidewalls 50, 52, 54 and 56 from which they depend so as to compensate for the thickness of the bottom closure flaps 68, 70, 72 and 74. Once the bottom closure flaps are folded inwardly into substantially right angles to the end and sidewall panels, the container body is ready for filling with its contents. Thereafter, the final step is to telescopically engage the container body 10 so that the inside surfaces of the sidewalls of the cover are disposed in face-to-face relationship with the outside surfaces of the liner panels in the container body.

Figure 5:
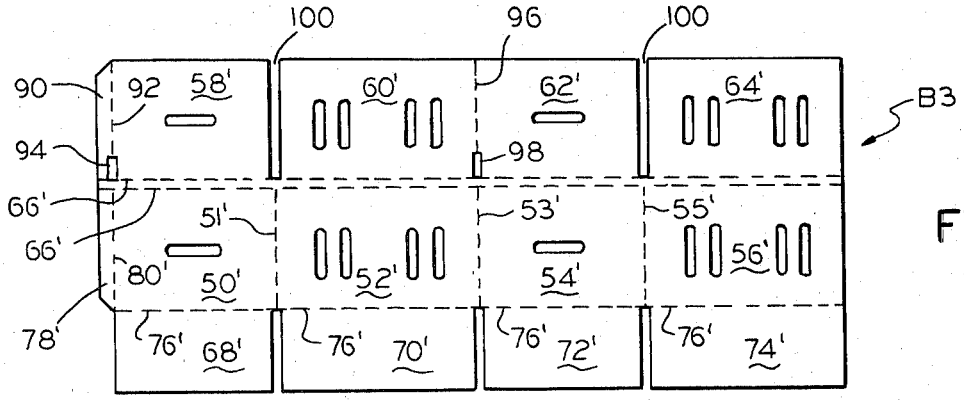
FIG. 5 is a top plan view of a one-piece blank utilized to form the container body of FIG. 2.
Figure 6:
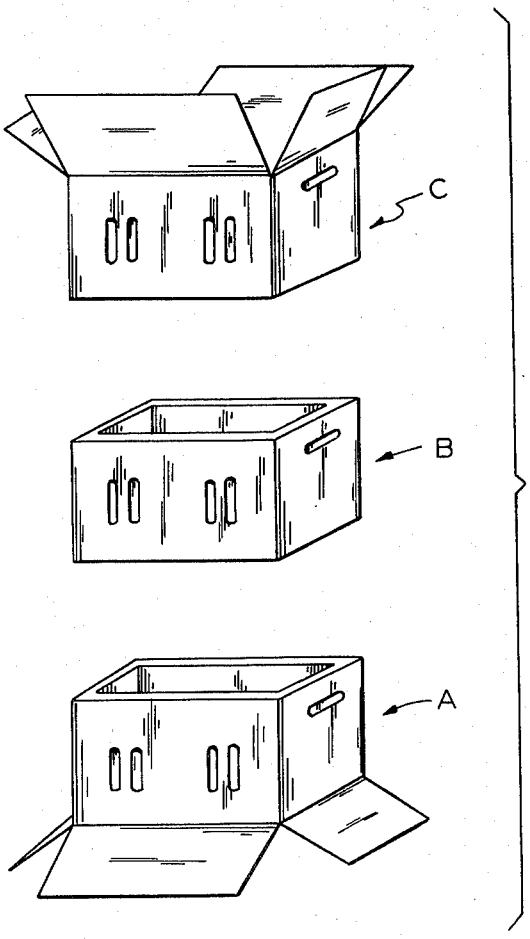
FIG. 6 (PRIOR ART)
FIG. 6 is an exploded perspective view of the prior art container.

A modified style or second embodiment of the blank B2 is shown in FIG. 5 and is designated as blank B3. Referring now to FIG. 5, this modification consists of a second or extension glue flap 90 joined to the free edge of the liner panel 58' along a corner score line 92 and to the first glue flap 78' along the double score lines 66'. The liner wall 58' and the first glue flap 78' correspond to the liner panel 58 and the first glue flap 78 of the structure shown in FIG. 4. In addition, a short V-shaped slot 94 serves to partially disconnect the second glue flap 90 and the liner wall 58' adjacent the double score line 66' so as to relieve stressing in the corners of the assembled container body. Similarly, the liner panels 60' and 62' are joined by a corner score line 96 and are partially disconnected by a short V-shaped slot 98 adjacent the double score lines 66' so as to relieve stress in the corners. It should also be noted that the liner panels 58', 60' and 62', 64' are separated by slots 100 extending downwardly to the double score lines 66', as opposed to being joined by score lines 84, 86 of the structure in FIG. 4. In all other respects, this structure is the same as that which has been described previously with respect to FIG. 4. Accordingly, a discussion of these identical elements has been omitted.

Since the assembly of the container body 10' is quite similar to that of the blank B2, only the differences will now be described. The second glue flap 90 is secured to the free edge of the endmost liner panel 64' by means of glue, taping, stitching or the like. By the provision of this second glue flap, it is now possible to merely fold downwardly and outwardly the liner panels 58', 60', 62' and 64' without the necessity of first reversely folding the knocked-down blank in the procedure described with respect to FIG. 4, thereby reducing labor costs in the set-up or assembly of the container.

From the foregoing detailed description, it can thus be seen that the present invention provides an improved telescoped container consisting of an opened top container body with an integral liner and a separate opened bottom container cover for telescoping over the container body, which is relatively simple to manufacture and easier to assemble. Further, the panels of the container body are joined integrally to outer liner panels along double score lines so as to increase stacking strength and enhance the appearance thereof. The container body may be provided with short V-shaped slots at certain corners between the body panels and liner panels so as to relieve stressing at the corners.

While there has been illustrated and described what is at present to be preferred embodiments of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiments disclosed as the best modes contemplated for carrying out this invention, but that the invention will include all embodiments falling within the scope of the appended claims.

What is claimed is:

1. A telescoped container for storage and transporting of foodstuffs such as bananas and the like, said container comprising:

an opened top container body with an integral liner;

a separate container cover telescopically disposed on said container body;

said cover consisting of four side panels and a glue flap interconnected along parallel fold lines and folded to form a tubular structure, said cover including closure flaps foldably joined to related upper edges of said respective side panels to form a top closure;

said body consisting of first, second, third and fourth upright sidewall panels connected along corner score lines and folded to form a tubular structure;

said integral liner consisting of first, second, third and fourth outer liner panels connected by double score lines to said first, second, third and fourth sidewalls respectively on the top edges thereof;

bottom closure means connected to the bottom edges of said sidewalls;

a first connecting flap foldably connected to the free edge of said first sidewall and adapted to be secured to an overlapping portion of said fourth sidewall to form the manufacturer's joint and said outer liner panels being reversely folded to lie in face-to-face relationship with the outer surfaces of said sidewalls to form an outer perimetrical reinforcement, the height of said liner panels being slightly greater than the height of said sidewalls to increase stacking strength; and said second and third outer liner panels being separated by a slot extending from the double score lines, the adjacent side edges of said first and second outer liner panels being connected by a corner score line, said third and fourth outer liner panels being connected by a corner score line, and said first and fourth outer liner panels being connected by a slot extending from the double score lines.

2. A telescoped container for storage and transporting of foodstuffs such as bananas and the like, said container comprising;

an opened top container body with an integral liner;

a separate container cover telescopically disposed on said container body;

said cover consisting of four side panels and a glue flap interconnected along parallel fold lines and folded to form a tubular structure, said cover including closure flaps foldably joined to related upper edges of said respective side panels to form a top closure;

said body consisting of first, second, third and fourth upright sidewall panels connected along corner score lines and folded to form a tubular structure;

said integral liner consisting of first, second, third and fourth outer liner panels connected by double score lines to said first, second, third and fourth sidewalls respectively on the top edges thereof;

bottom closure means connected to the bottom edges of said sidewalls;

a first connecting flap foldably connected to the free edge of said first sidewall and adapted to be secured to an overlapping portion of said fourth sidewall to form the manufacturer's joint and said outer liner panels being reversely folded to lie in face-to-face relationship with the outer surfaces of said sidewalls to form an outer perimetrical reinforcement, the height of said liner panels being slightly greater than the height of said sidewalls to increase stacking strength;

a second glue flap being partially disconnected to an edge of said first liner panel by a short V-shaped slot and to said first glue flap along said double score line, said second glue flap being adapted to be secured to an overlapping portion of said fourth liner panel; and the adjacent side edges of said second and third outer liner panels being partially disconnected near the double score line by a short V-shaped slot so as to relieve stress in the corner, said first and second outer liner panels being separated by a slot extending from the double score lines, and the second and third outer liner panels being separated by a slot extending from the double score lines.

* * * * *